United States Patent [19]

Baker

[11] 4,024,663

[45] May 24, 1977

[54] CYLINDER LOCK FOR REVOLVERS

[76] Inventor: Wayne B. Baker, P.O. Box 188, Freedom, Idaho 83120

[22] Filed: Aug. 18, 1975

[21] Appl. No.: 605,669

[52] U.S. Cl. ..... 42/67

[51] Int. Cl.[2] ..... F41C 1/00

[58] Field of Search ..... 42/67, 65

[56] References Cited

UNITED STATES PATENTS

| | | | |
|---|---|---|---|
| 161,615 | 4/1875 | Hood | 42/67 |
| 336,894 | 3/1886 | Cilley | 42/67 |
| 650,931 | 6/1900 | Ehbets et al. | 42/67 |
| 2,733,529 | 2/1956 | Ruger | 42/67 |
| 3,187,454 | 6/1965 | Geber | 42/67 |
| 3,831,305 | 8/1974 | Casull | 42/67 |

*Primary Examiner*—Charles T. Jordan
*Attorney, Agent, or Firm*—B. Deon Criddle

[57] ABSTRACT

A cylinder lock for a revolver adapted to be positioned entirely within the body of the revolver to release the cylinder during cocking of the revolver hammer and to lock the cylinder against turning during firing of the revolver and when the hammer is in a forward position. A locking bar has a cylinder engaging lug on one end and is pivotally connected adjacent its other end to the frame handle of the revolver. A spring loaded pin carried by the hammer moves the locking bar such that the lug is moved out of a notch provided therefor in the cylinder to allow rotation of the cylinder and the pin is then moved into an enlarged notch on the locking bar and is cammed into the hammer to allow the lug of the bar to be biased by a spring at the other end of the bar into position in a new notch of the cylinder. After the trigger is pulled the pin is biased from the hammer to again be in position to move the locking bar.

5 Claims, 6 Drawing Figures

CYLINDER LOCK FOR REVOLVERS

FIELD OF THE INVENTION

This invention relates to firearms and more particularly to revolvers and means for locking and releasing the rotating cylinders of such revolvers.

PRIOR ART

Revolvers of various size and shapes have been well known for more than a hundred years. In almost all such weapons there is provided some means for sequentially locking the rotatable cylinder in which cartridges are placed such that the cartidges are properly positioned to be contacted and fired by a hammer of the revolver. With large size hand guns the cylinder lock can be rather easily accommodated and various cams or levers can be used to move it during the times the cylinder must be free to revolve. In smaller sized revolvers it is often difficult to properly position all of the actuating components and the component sizes must often be greatly reduced. This size reduction often results in a weakening of compnents and early failure of the weapon.

BRIEF DESCRIPTION OF THE INVENTION

Principal objects of the present invention are to provide a spring biased cylinder lock that can be used even with very small sized revolvers and that will be operated by a single spring biased pin carried by the hammer of the revolver. Another object is to provide a cylinder lock that can be mounted closely adjacent the frame of the revolver so that it can be as large as possible, thereby having the necessary strength to insure continuing operation and long use.

Still other objects of the invention are to provide a biasing means for the locking bar that does not require space therefor closely adjacent to the cylinder, but that will tend to force the lug into cylinder engagement, and to provide operating means carried by the hammer for moving the lug away from the cylinder and not requiring links, levers, etc. in the operation thereof.

Principal features of the invention include a locking bar having a locking lug on one end thereof to engage notches provided therefor in usual fashion on the outside of a revolver cylinder; a camming notch and a pivot connection formed intermediate the length of the locking bar; and a spring receiving hole in the end of the locking bar opposite the locking lug.

A spring biased pin carried by the revolver hammer pivots the locking bar to release the locking lug from the cylinder notches and moves into the camming notch such that the lug can move back into engagement with a notch on the cylinder when the hammer is fully cocked. As the pin moves into the camming notch it is forced into the hammer, against the bias of a spring. Pulling of the trigger releases the hammer to allow it to pivot forward whereupon it will strike and fire a cartridge properly positioned in the cylinder. Such movement of the hammer is permitted by the locking bar, since the pin carried by the hammer remains in the hammer until it can spring out after moving to a position above the bar, to thereby be in position to engage the top of the locking bar during a subsequent rearward pivoting of the hammer.

Additional objects and features of the invention will become apparent from the following detailed description, taken together with the accompanying drawing.

THE DRAWING

In the drawings:

FIG. 1 is a perspective view of a small revolver incorporating the cylinder lock of the invention;

FIG. 2, a side elevation view of the revolver of FIG. 1, with a side plate removed to show interior components;

FIG. 3, a view of the locking bar of the cylinder lock, turned to show the opposite side of the locking bar and the camming notch;

FIG. 4, an enlarged, fragmentary, sectional view of the pin carried by the hammer and the locking bar, take on the line 4-4 of FIG. 2;

FIG. 5, a fragmentary view of the revolver frame and handle, with the locking bar removed so that the trigger and hammer can be viewed, with the hammer in a safety position; and FIG. 6, a view like that in FIG. 5, but with the hammer in a cocked position.

DETAILED DESCRIPTION

Figure 1:
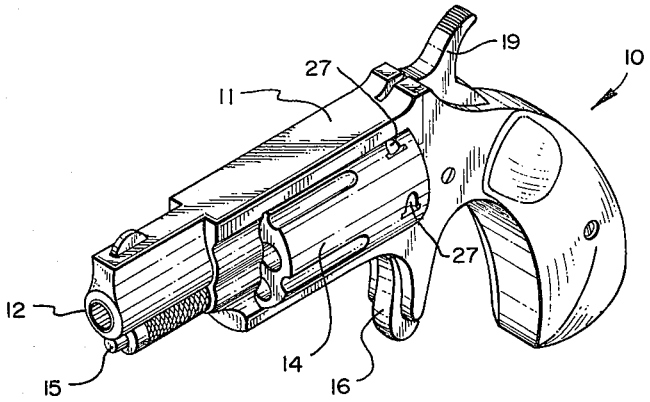

Referring now to the drawing:

In the illustrated preferred embodiment a revolver, shown generally at 10 has the usual frame 11, with a barrel 12 and handle 13. A cylinder 14 is mounted in frame 11 and is held in place by a cylinder lock pin 15 that also serves as an axis about which the cylinder revolves. A trigger 16 is pivotally mounted by a pin 17 to the frame 11 and a spring 18 that is partially recessed in the frame engages the trigger to bias it to a forward position.

Figure 6:
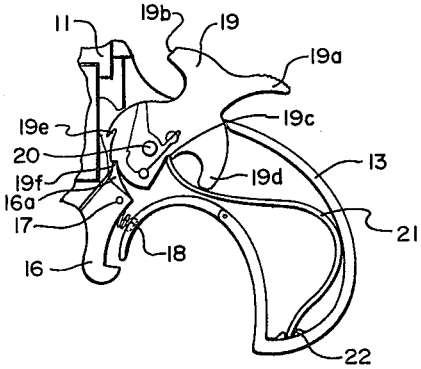

A hammer 19 is pivotally mounted to the frame 11 by a pivot pin 20. The hammer includes a thumb projection **19*a* to be used in pivoting the hammer to a cocked position, a striker 19*b* that engages a cartridge placed in the cylinder, a notch 19*c* to engage one end of a flat spring 21, the other end of which is anchored in handle 13 at 22. A spring engaging finger 19*d* engages spring 21 to deflect it and to insure a rapid and positive forward pivoting of the hammer when the hammer is released from its fully cocked position, as shown in FIG. 6. A safety notch 19*e* and a latch shoulder 19*f* are arranged to be sequentially engaged by a finger 16*a* on trigger 16** to hold the hammer in a safety position and a fully cocked position, respectively.

A hair spring 23, positioned in a recessed portion **19*g* of hammer 19 is tensioned around the pivot pin 20 and has one end anchored in a slot 19*h* provided therefor in the hammer. The other end of the spring 23 engages a pawl 24 that is connected to the hammer by a pivot pin 25. As is well known, the pawl engages radially positioned cams on the cylinder 14** to partially rotate the cylinder upon cocking of the hammer.

The mechanism heretofore described, including the revolver frame, handle, barrel, cylinder, cylinder locking pin, the means for operating the cylinder in response to cocking of the hammer, the hammer operating spring and the trigger assembly are all well known and do not, per se, constitute part of the present invention. Similarly, the notches 27 spaced around the cylinder 14 to provide means for locking the cylinder in position as it is sequentially rotated are well known.

Figure 2:
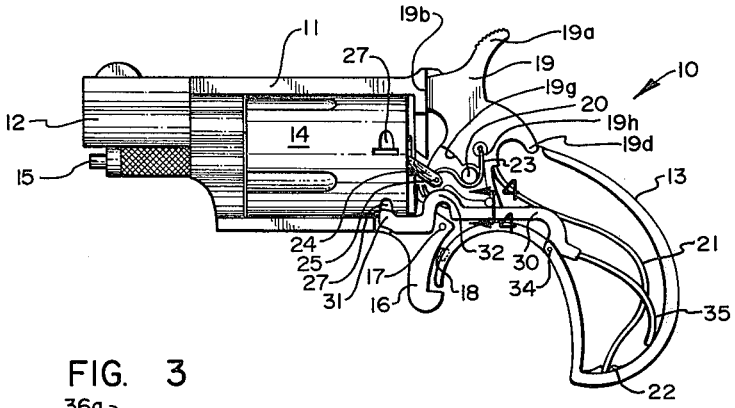
Figure 3:
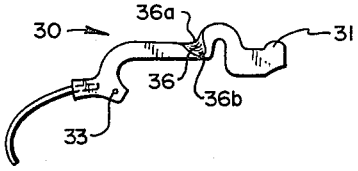

In the present invention, a locking bar, shown generally at 30 has a locking lug 31 projecting from one end and adapted to fit into the notches 27. The locking bar is of generally elongate construction, although it may have a hump 32 therein to allow it to clear the pivot pin 17 for the trigger, and may be curved to conform to the revolver frame configuration and to provide a boss through which a hole 33 (FIG. 3) may be formed. As shown in FIG. 2, a pin 34 inserted through frame members and hole 33 serves as a pivot shaft for the locking bar. A curved spring 35 has one end inserted into the end of the locking bar opposite to the locking lug and its other end extending past the spring 21 and abutting the lower inside of the handle 13 of frame 11. So arranged, the spring acts on the end of the locking bar to which it is attached to bias that end down and the locking lug up into engagement with the cylinder 14.

Figure 4:
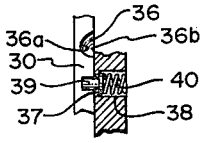
Figure 5:
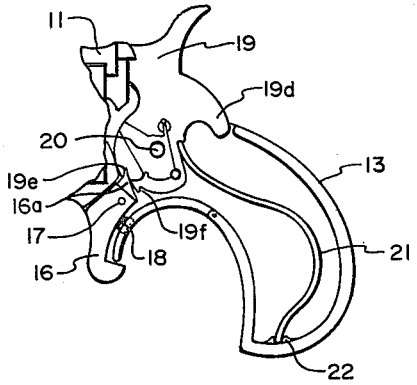

A camming notch 36 (FIGS. 3 and 4) is formed on the inside of the locking bar 30 and the notch is formed to extend deeply into the locking bar at the top 36*a* thereof and then is inclined towards the locking lug and out to the inner face of the bar at the bottom 36*b* thereof.

Hammer 19 has a bore 37 extending therethrough, and a large counterbore 38 to receive the head of a pin 39 that extends through the bore 37. A spring 40 is positioned witin the counterbore 38 and is held therein by engagement with the frame 11 when the hammer is pivotally mounted to the frame. When the hammer is in its fully forward or firing position the pin 39 extends from the hammer above the locking bar 30. Pivoting of the hammer to a cocked position then slides the pin 39 along the locking bar and forces the locking bar down, thereby moving the locking lug 31 from a notch 27. At the same time, the pivoting of the hammer will rotate the cylinder to place a new chamber beneath the hammer when the hammer is fired.

Just before the pivoting hammer reaches its fully cocked position the pin 39 moves into the camming notch 36 at which time the locking bar is again biased up by spring 35. As the locking bar moves up it forces the pin 39 (which is in the camming notch) into a retracted position in the hammer 19, against the bias of spring 40. The pin 39 is held in this retracted position by its engagement with the inside face of the locking bar and the cylinder is locked by the locking lug carried by the locking bar engaging a notch 27.

When the hammer is released, by pulling on trigger 16, thereby releasing shoulder 19*f* of the hammer from finger 16*a* of the trigger, spring 21 biases the hammer forward to its firing position. Striking of a cartridge in cylinder 14 by striker 19*b* of the forward moving hammer will then fire the cartridge, in well known fashion. As the hammer moves into its firing position the spring biased pin 39 moves clear of the locking bar and is biased by spring 40 to its position extending over the locking bar.

As the hammer 19 is pivoted to its fully cocked position wherein shoulder 19*f* is engaged by finger 16*a* of the trigger it first passes a safety position wherein the notch 19*e* is engaged by the finger 16*a*. In this safety position the pin 39 is still above the locking bar, the locking bar is pivoted downwardly slightly but the locking lug has not cleared the notches 27. Because of the depth and angle of safety notch 19*e* it is necessary that the hammer be pivoted to move the notch past finger 16*a* and then be reversely pivoted to move the finger into the notch. When the finger is in the notch the trigger 16 cannot be pivoted and the gun is in a safe condition. Such a safety arrangement is well known and does not constitute part of the present invention.

With the cylinder lock shown and described, the locking bar can be made of relatively large stock, capable of withstanding long and arduous usage and neither the locking bar or its biasing spring take up space within the frame that is required for other components. In addition, the single spring biased pin 39, replaces various links, arms and cams common to previously known revolvers.

Although a preferred embodiment of my invention has been herein disclosed, it is to be understood that the present disclosure is made by way of example and that variations are possible without departing from the subject matter coming within the scope of the following claims, which subject matter I regard as my invention.

I claim:

1. A cylinder lock for revolvers having a frame including a handle and a barrel, a rotatable cylinder pivotally mounted in the frame, said cylinder having spaced notches formed therearound and a spring biased hammer pivotally mounted to the frame, and means carried by the hammer and the cylinder, whereby the cylinder is partially rotated each time the hammer is cocked, said cylinder lock comprising a locking bar;

means for pivotally mounting the locking bar to the frame;

a locking lug carried by said locking bar and adapted to extend into the notches of the cylinder;

means biasing the locking bar such that the locking lug is biased into said notches; a camming notch carried by one face of the locking bar;

pin means including a pin carried by and projecting from the hammer, said pin pivoting the locking bar downwardly before moving into the camming notch and being forced into the hammer upon pivoting of the hammer to a cocked position, whereby the locking bar is pivotable upwardly to move the locking lug into a cylinder notch; and means biasing said pin to project from the hammer and over the locking bar when the hammer is in a forward firing position.

2. A cylinder lock as in claim 1, wherein the locking bar is pivotally mounted to the frame handle.

3. A cylinder lock as in claim 2, wherein the means biasing the locking bar comprises a curved spring having one end extending into the locking bar at a side of the pivot mounting of the locking bar opposite to the locking lug and the other end in engagement with the frame handle.

4. A cylinder lock as in claim 3, wherein the means biasing the pin to project from the hammer comprises a spring positioned in a counterbore of the hammer and having one end engaging the pin and the other end engaging the frame.

5. A cylinder lock for revolvers having a frame including a handle and a barrel, a cylinder rotataby mounted in the frame, said cylinder having spaced notches formed therearound and a spring biased hammer pivotally mounted to the frame, and means carried by the hammer and the cylinder, whereby the cylinder is partially rotated each time the hammer is cocked, said cylinder lock comprising a locking bar having a camming notch in one face thereof;

means for pivotally mounting the locking bar to the frame handle;

a locking lug carried by said locking bar and adapted to extend into the notches of the cylinder;

means biasing the locking bar such that the locking lug is biased into said notches, said means biasing the locking bar comprising a curved spring having one end fixed to the locking bar opposite at a side of the pivot mounting of the locking bar to the locking lug and the other end in engagement with the frame handle;

a pin carried by and projecting from the hammer, said pin being moved into the camming notch upon pivoting of the hammer to a cocked position; and means biasing said pin to project from the hammer and beyond a face of the locking bar when the hammer is in a forward firing position, said means biasing said pin comprising a spring positioned in a counterbore of the hammer and having one end engaging the pin and the other end engaging the frame.

* * * * *